US005628077A

United States Patent [19]

Briganti

[11] Patent Number: 5,628,077

[45] Date of Patent: May 13, 1997

[54] DRAW STRING FITTED SHEET WITH CURVED HEM FOR EVEN TENSION

[76] Inventor: Robert A. Briganti, 2040 Noche Buena St., Seaside, Calif. 93955

[21] Appl. No.: 696,318

[22] Filed: Aug. 13, 1996

Related U.S. Application Data

[63] Continuation of Ser. No. 280,778, Jul. 26, 1994, abandoned.

[51] Int. Cl.[6] ..... A47G 9/02

[52] U.S. Cl. ..... 5/496; 5/499

[58] Field of Search ..... 5/495, 496, 497, 5/498, 499, 500

[56] References Cited

U.S. PATENT DOCUMENTS

| | | | |
|---|---|---|---|
| 2,630,588 | 3/1953 | Levin | 5/496 |
| 2,886,833 | 5/1959 | Enger | 5/496 |
| 3,858,256 | 1/1975 | Beer | 5/334 |
| 3,900,909 | 8/1975 | Monier | 5/334 |
| 4,495,233 | 1/1985 | Bassetti | 5/496 X |
| 4,642,826 | 2/1987 | Bassetti | 5/496 |
| 4,727,608 | 3/1988 | Joyce | 5/496 |
| 4,970,744 | 11/1990 | Davis | 5/496 |
| 5,020,177 | 6/1991 | Etherington | 5/496 |
| 5,046,207 | 9/1991 | Chamberlain | 5/496 |

*Primary Examiner*—Michael F. Trettel

[57] ABSTRACT

A fitted sheet with draw string sewn in a hem on the peripheral edges. The edges are fashioned so that the final shape of the hem, when the sheet is installed on the mattress is not parallel to the edges of the mattress and forms a curve resembling an ellipse beneath the mattress providing for the enhanced distribution of the tension substantially throughout and across the sheet face.

20 Claims, 2 Drawing Sheets

DRAW STRING FITTED SHEET WITH CURVED HEM FOR EVEN TENSION

This application is a continuation of application Ser. No. 08/280,778 filed Jul. 26, 1994, which is now abandoned.

FIELD

The field of this invention relates to bed cloths or sheets, particularly fitted sheets with draw strings.

BACKGROUND

Fitted sheets have been designed in the past in the attempt to overcome a few basic problems involved with securing and tensioning the sheet. The problems include holding the sheet in place on the mattress; holding the sheet tight and wrinkle free across the top face of the mattress and at the same time providing for their easy removal and replacement.

The most popular design and the one in use over much of the world is the elastic corner design. This design provides for the easy application and removal of the sheet but does not anchor the sheet securely; they often come loose and are never held completely tight across the face of the mattress.

PRIOR ART

The long list of patents concerning draw string sheets include many design attempts to solve these simple problems. These designs have failed to solve all these problems at the same time. The most valid prior art list includes the following:

Beer U.S. Pat. No. 3,858,256 Jul. 7, 1975 is a very complicated attempt at securing and tightening the sheet. It requires a prohibitive amount of fabrication difficulties and material expense. It would also be very time consuming to apply to a bed. And unlike the design covered by this application the hem where the straps are secured when installed are parallel to the sides of the mattress providing no tension across the face of the sheet.

Monier U.S. Pat. No. 3,900,909 Aug. 26, 1975 requires that each corner of the bed be accessible and also requires that each corner be secured and removed one at a time causing considerable frustration. Also this design lacks any means to provide tension anywhere other than the corners.

Joyce U.S. Pat. No. 4,727,608 Mar. 1 1988 describes a system where a pre-curled plastic insert in the sheets hem draws the sheet tight when it returns to its' performed curve when applied to the mattress. It is doubtful that this design would actually work, but if it did, the installer would have to lift the side of the mattress in order to allow the sheet to slide under. The same would be true at removal with perhaps even more difficulty struggling with the resistant insert while holding the mattress up for access.

Davis U.S. Pat. No. 4,970,744 Nov. 20, 1990; Etherington U.S. Pat No. 5,020,177 Jun. 4, 1991; Chamberlain 5,046,207 Sept. 10 1991, all provide a slightly easier way to apply and remove the sheets but the drawstring is still difficult to access. Also the shape of the hem when installed is parallel to the sides of the mattress causing a gathering of the hem only at the corners and providing no tension across the face of the mattress.

OBJECT OF INVENTION

It is the object of my fitted sheet is to provide a simple and inexpensive means of releasably securing the sheet in position on a mattress. It is also an object of ny fitted sheet to provide a means of tensioning the sheet and eliminating the tendency of the sheet to become wrinkled when slept on.

Other objects and advantages of my fitted sheet will be readily appreciated by those with ordinary skill in the art as the same becomes better understood by reference to the following detailed description when considered in conjunction with the following drawings in which.

SUMMARY

In accordance with the present invention a drawstring sheet comprises a peripheral hem containing the drawstring strategically curved in sections where it falls adjacent to the lower edges of the mattress to distribute the generation of tension forces along the lower edges and away from the corners.

DESCRIPTION

These embodiments illustrated in all the figures are fabricated in the same manor as anyone skilled in the art will have made other fitted sheets except what is specified below. The materials except differences specified will also remain conventional.

Figure 1:
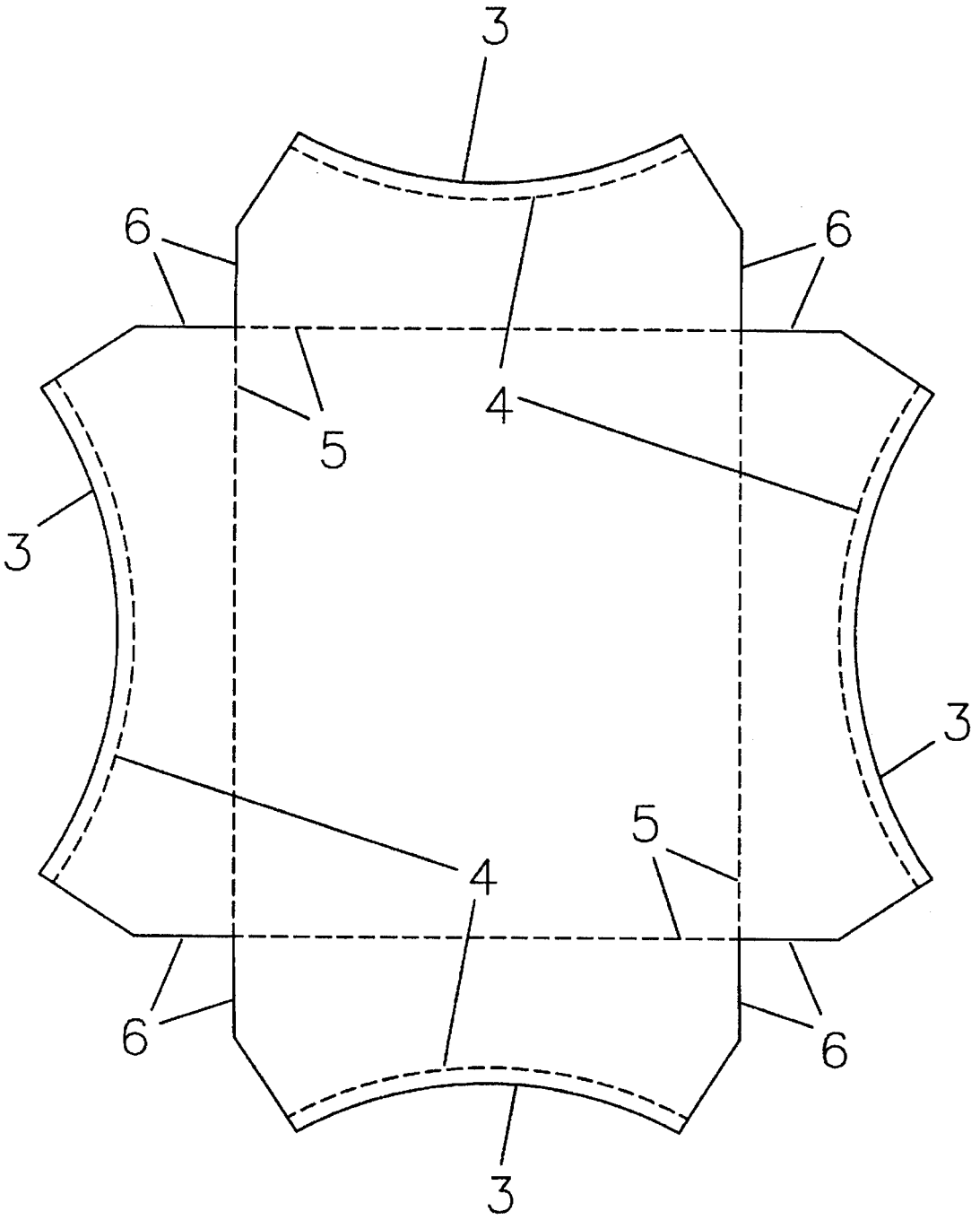
FIG. 1 illustrates an approximate pattern for the material used to form the main body of the sheet.
Figure 2A:
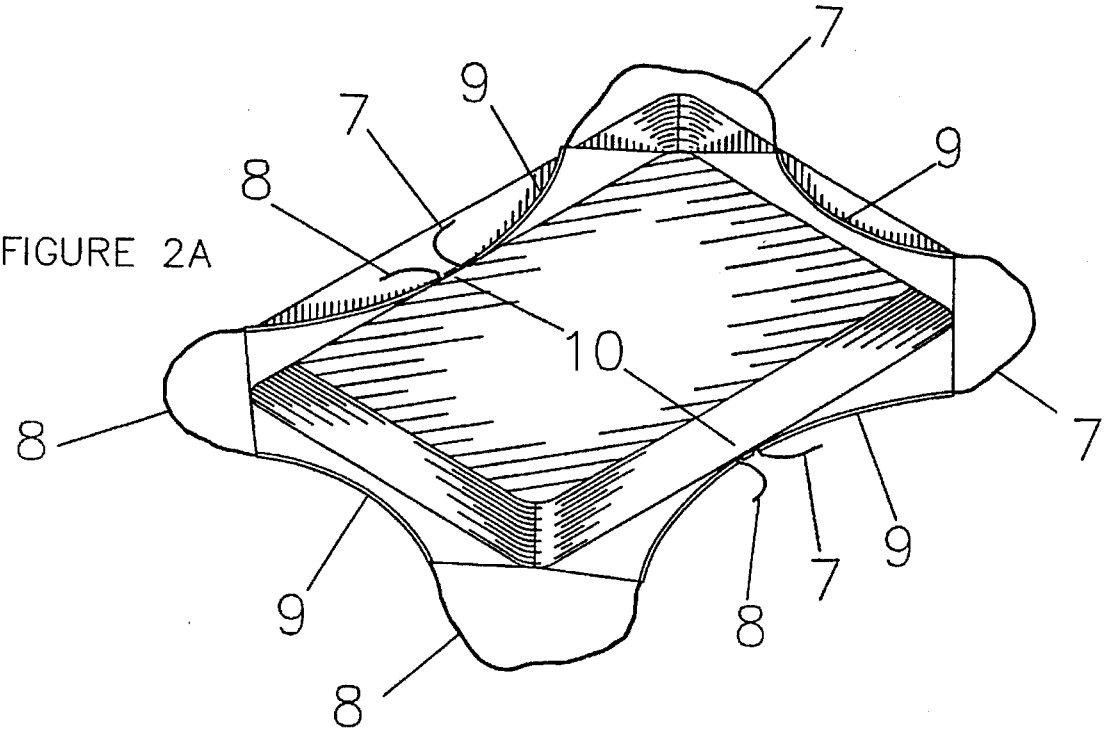
FIG. 2A illustrates, from below, the fitted sheet fully fabricated in position to be placed on the mattress.
Figure 2B:
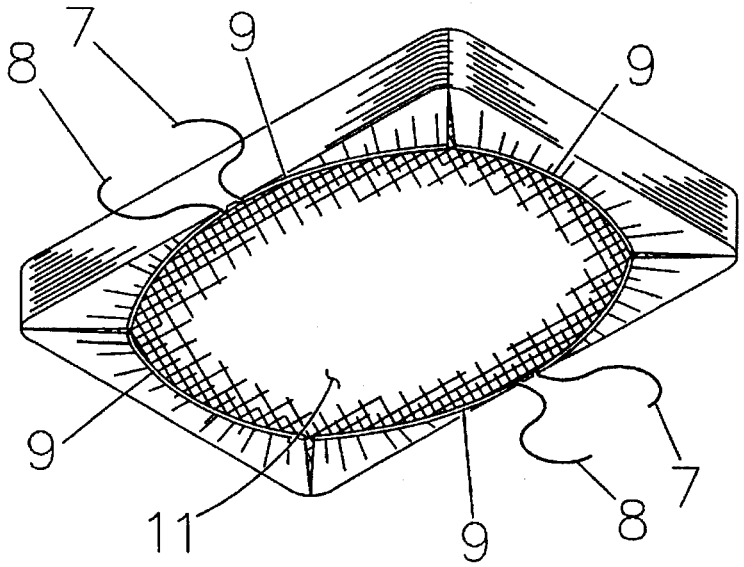
FIG. 2B illustrates, from below, the fitted sheet installed on the mattress with the draw string tight.

FIG. 1 shows the approximate pattern for material used for the main body of sheet. The particular feature of note is the shape of edges 3. Edges 3 are shaped in a substantially concave curve which is crucial for the proper function of this invention. Edges 3 are positioned to fall substantially under the mattress when sheet is in its final position on mattress. The pattern may be sized and proportioned to accommodate any of the many mattress sizes available. Broken lines 4 and 5 represent where material is to be bent or folded. Broken lines 5 are where material is bent to form the sides of the envelope corresponding to the sides of the mattress. The material is bent lip 90 degrees at line 5 and sewn to the adjacent side at each end 6. The hem which holds draw string 7 and 8 seen in FIGS. 2A and 2B is formed by folding the edges 3 at broken lines 4. Hem 3 may also be made separately of an appropriate low friction material and sewn on edges 3.

FIG. 2A shows my fitted sheet fully fabricated and a in position to be placed on a mattress. Draw strings 7 and 8 run through each hem 9 in sequence around the sheet and exit the hem at openings at position 10. In other embodiments only one string may be used. In this case, openings need only be provided on one side of the sheets. Quick release clasps, of the many types available, can be added at positions 10 to hold draw strings 7 and 8 tight.

FIG. 2B shows the fitted sheet in position on mattress 11, with draw strings 7 and 8 tight. The shape of hem 9 is seen here to resemble an ellipse characterizing the key feature of this invention.

OPERATION

The operation of my fitted sheet is simple. The sheet is placed over mattress, the hems with the draw strings are tucked under mattress and the draw string is then pulled tight and fastened.

CONCLUSION AND RAMIFICATIONS

With the broad use of my fitted sheet, the problem of fitted sheets coming loose and/or becoming wrinkled on the bed can be eliminated.

This is only one of the preferred embodiments of my fitted sheets. Many possibilities exist that may fulfill the object of this invention, the scope of which is covered in the following claims.

I claim:

1. A fitted sheet for a mattress; said mattress having a set of sides, a top, and a bottom; said bottom and said sides intersecting to form a set of lower edges; each of said lower edges having a midpoint; said lower edges intersecting to form a set of lower corners; said sheet having a peripheral edge with a hem thereon; at least one part of or all said hem forming a hollow cavity substantially parallel to said sheet edge; at least one part or all of said hem containing at least one drawstring therein; said drawstring restrained within said hem and under a first tension force generates a second tension force in said sheet wherever said drawstring is caused by said sheet to make a deviation from a substantially straight path; said second tension force holds said sheet in a position substantially enveloping said mattress in such a way as to substantially cover said mattress top and said sides with all or part of said sheet edge, said hem, and said at least one drawstring in a position adjacent to and substantially within said mattress lower edges; a set of portions of said sheet edge supporting said hem containing said drawstring and adjacent to said mattress lower edges having a substantially concave curve fashioned to substantially direct said drawstring deviation toward and distribute said drawstring deviation along said portions of said sheet edge adjacent to said mattress lower edges whereby the generation of said second tension force in said sheet is substantially diverted toward and along said portions of said sheet edge adjacent to said mattress lower edges.

2. The fitted sheet in claim 1, having a set of tabs adjacent to said mattress lower edges; a plurality of said tabs having a long edge; each of said tab long edges having said substantially concave curve.

3. The fitted sheet in claim 1, with said portions of said sheet edge comprising an elliptical shape substantially beneath said mattress.

4. The fitted sheet in claim 1, with said substantially concave curve further fashioned whereby each of said portions of said edge are not substantially parallel to any said mattress lower edges.

5. The fitted sheet in claim 1, with said substantially concave curve further fashioned whereby each of said portions of said edge are non-parallel.

6. The fitted sheet in claim 1, with said substantially concave curve further fashioned whereby said portions of said edge are generally closer to said mattress lower edges where said portions of said edge are near said midpoint of said mattress lower edges than where said portions of said edge are near said mattress lower corners.

7. A fitted sheet for a mattress; said mattress having a volume; said mattress having a set of sides, a top, and a bottom; said bottom and said sides intersecting to form a set of lower edges; each of said lower edges having a midpoint; said lower edges intersecting to form a set of lower corners; said sheet fashioned with a main chamber to substantially envelope said mattress, and a main opening to allow said mattress to enter said main chamber; said main chamber having a variable volume; said main opening having a peripheral edge with a hem thereon; at least one part or all said hem forming an elongated hollow cavity substantially parallel and adjacent to said sheet edge; at least one part or all of said cavity containing at least one drawstring therein encircling said main opening; said main opening is forced to a more closed size substantially under said mattress by a first tension force in said drawstring capturing said mattress inside said chamber and causing said main chamber volume to shrink around said mattress; said drawstring further generating a second tension force in said sheet as said sheet resists further shrinkage as said chamber volume approaches that of said mattress volume; said second tension force is generated in said sheet wherever there is a deviation of said drawstring from a substantially straight path; said second tension force holds said sheet in a position substantially enveloping said mattress in such a way as to substantially cover said mattress top, and said sides with all or part of said sheet edge, said hem, and said drawstring in a position adjacent to and substantially within said mattress lower edges; a set of portions of said sheet edge supporting said hem containing said drawstring and adjacent to said mattress lower edges having an edge shape means for substantially diverting said drawstring deviation from a straight path toward and distributing said deviation along said set of portions of said sheet edge adjacent to said mattress lower edges whereby said second tension force is substantially generated along said portions of said sheet edge adjacent to said mattress lower edges.

8. The fitted sheet in claim 7, with said edge shape means forming a substantial curve whereby each of said portions of said sheet edge are not substantially parallel to any of said mattress lower edges.

9. The fitted sheet in claim 7, with said edge shape means further fashioned with a substantial curve whereby each of said portions of said sheet edge are non-parallel.

10. The fitted sheet in claim 7, with said set of portions of said sheet edge having said edge shape means comprising an elliptical shape substantially beneath said mattress.

11. The fitted sheet in claim 7, with said edge shape means further forming a curve which is generally closer to said mattress lower edges where said set of portions of said sheet edge are near said midpoint of said mattress lower edges than where said portions are near said mattress lower corners.

12. The fitted sheet in claim 7, having a plurality of tabs adjacent to said mattress lower edges; a plurality of said tabs having a long edge; each of said tab long edges having said edge shape means.

13. The fitted sheet in claim 7, with said edge shape means further forming a substantially concave curve.

14. A cover for a substantially prismatic object; said prismatic object having a set of rectangular sides, a polygonal top, and a polygonal bottom; said prismatic object polygonal top, and said polygonal bottom each having a set of edges, and a set of corners; each of said polygonal bottom edges having a midpoint; said cover fabricated from a flexible membrane material having at least one edge; said cover formed with a chamber to substantially envelope said object; said chamber having a variable volume; said chamber having an opening formed by said cover edge to allow entrance of said object; said cover having at least one flexible tubular member attached adjacent to said edge; said tubular member having a diameter; said tubular member having a length larger than said tubular member diameter; at least one part or all of said tubular member containing at least one drawstring therein; said at least one drawstring encircles said chamber opening; said at least one drawstring under a first tension force closes said opening restraining said object inside said chamber generating a second tension force in said cover decreasing said volume of said chamber and tightening said cover around said object; said second tension force is induced in said cover wherever said at least one drawstring forms a first curve; said first curve translated to said at least one drawstring by an edge shape means for substantially directing said first curve to and distributing said first curve along a plurality of said prismatic object bottom edges whereby said cover is held in position by said second tension forces generated substantially adjacent to and along a plurality of said prismatic object polygonal bottom edges.

15. The cover in claim 14 with said edge shape means further fashioned to cause said at least one drawstring to form a second curve substantially beneath said object substantially resembling an ellipse.

16. The cover in claim 14, with said edge shape means further fashioned to cause said at least one drawstring to form a second curve not substantially parallel to any said prismatic object polygonal bottom edges.

17. The cover in claim 14, with said edge shape means further fashioned whereby all pans of said edge shape means are non-parallel.

18. The cover in claim 14, having a set of tabs adjacent to said polygonal bottom edges; a plurality of said tabs having a long edge; each of said tab long edges having said edge shape means.

19. The cover in claim 14, with said edge shape means further forming a second substantially concave curve.

20. The cover in claim 14, with said edge shape means further forming a second curve which is generally closer to said object bottom edges where said second curve is near said midpoint of said object bottom edges than where said second curve is near said object bottom corners.

* * * * *